US010935926B2

(12) United States Patent
Takeuchi et al.

(10) Patent No.: US 10,935,926 B2
(45) **Date of Patent: *Mar. 2, 2021**

(54) CARTRIDGE, PROCESS CARTRIDGE, AND IMAGE FORMING APPARATUS

(71) Applicant: CANON KABUSHIKI KAISHA, Tokyo (JP)

(72) Inventors: Toshiaki Takeuchi, Susono (JP); Takahito Ueno, Mishima (JP); Yuuki Nakamura, Mishima (JP); Kensuke Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/782,520

(22) Filed: Feb. 5, 2020

(65) Prior Publication Data

US 2020/0174422 A1 Jun. 4, 2020

Related U.S. Application Data

(62) Division of application No. 16/297,888, filed on Mar. 11, 2019, now Pat. No. 10,579,012, which is a division of application No. 15/553,002, filed as application No. PCT/JP2016/000957 on Feb. 23, 2016, now Pat. No. 10,268,156.

(30) Foreign Application Priority Data

Feb. 27, 2015 (JP) ..... JP2015-037953

(51) Int. Cl.
*G03G 21/16* (2006.01)
*G03G 21/18* (2006.01)

(52) U.S. Cl.
CPC ..... *G03G 21/1814* (2013.01); *G03G 21/1842* (2013.01); *G03G 2221/1861* (2013.01); *G03G 2221/1884* (2013.01)

(58) Field of Classification Search
CPC ..... G03G 21/1814; G03G 21/1825; G03G 21/1842; G03G 2221/1654; G03G 2221/1861; G03G 2221/1884
(Continued)

(56) References Cited

U.S. PATENT DOCUMENTS 6,289,190 B1 9/2001 Amamiya et al.
6,308,024 B1 10/2001 Nakayama et al.
(Continued)

FOREIGN PATENT DOCUMENTS

CN 102981385 A 3/2013
CN 103309206 A 9/2013
(Continued)

OTHER PUBLICATIONS

Office Action in Korean Patent Application No. 10-2017-7026187, dated Aug. 8, 2018.
(Continued)

*Primary Examiner* — Hoan H Tran
(74) *Attorney, Agent, or Firm* — Venable LLP

(57) ABSTRACT

A technique enabling downsizing of an image forming apparatus is provided. A cleaning unit 13 attachable to and detachable from an apparatus main body of an image forming apparatus 100 that forms an image on a recording material 12 is provided, with this cleaning unit 13 including: a photosensitive drum 1; and a cleaning frame body 14 that supports the photosensitive drum 1 and that includes an opening 14*c* through which laser light 3*c* for exposing the photosensitive drum 1 can pass, wherein the opening 14*c* is configured such that a width of the opening 14*c* in a scanning direction in an irradiation range of the light for exposing the photosensitive drum 1 becomes greater toward a side of the photosensitive drum 1 from a side of a light source of light for exposing the photosensitive drum 1.

14 Claims, 9 Drawing Sheets

(58) Field of Classification Search
USPC ..... 399/107, 110–113, 117–119, 126
See application file for complete search history.

(56) References Cited

U.S. PATENT DOCUMENTS 6,349,182 B2 2/2002 Ostubo et al.
6,385,416 B1 5/2002 Horikawa et al.
6,608,980 B2 8/2003 Murayama et al.
6,714,752 B2 3/2004 Ueno et al.
6,823,153 B2 11/2004 Ueno et al.
6,829,455 B2 12/2004 Yasumoto et al.
6,834,175 B2 12/2004 Murayama et al.
6,898,391 B2 5/2005 Numagami et al.
6,912,365 B2 6/2005 Ueno et al.
6,954,600 B2 10/2005 Fujita et al.
6,954,601 B2 10/2005 Numagami et al.
6,968,146 B1 11/2005 Fujita et al.
6,970,668 B2 11/2005 Ueno et al.
6,978,099 B2 12/2005 Ueno et al.
6,983,114 B2 1/2006 Arimitsu
7,003,247 B2 2/2006 Koishi et al.
7,058,337 B2 6/2006 Hashimoto et al.
7,062,200 B2 6/2006 Ueno et al.
7,092,658 B2 8/2006 Yasumoto et al.
7,139,502 B2 11/2006 Koishi et al.
7,158,749 B2 1/2007 Ueno et al.
7,164,875 B2 1/2007 Miyabe et al.
7,174,122 B2 2/2007 Fujita et al.
7,184,690 B2 2/2007 Ueno et al.
7,209,682 B2 4/2007 Nunmagami et al.
7,248,810 B2 7/2007 Miyabe et al.
7,298,990 B2 * 11/2007 Nishimura ..... G03G 21/1821 399/111
7,315,710 B2 1/2008 Ueno et al.
7,366,452 B2 4/2008 Fujita et al.
7,440,715 B2 10/2008 Numagami et al.
7,450,877 B2 11/2008 Miyabe et al.
7,457,566 B2 11/2008 Koishi et al.
7,483,646 B2 1/2009 Ueno et al.
7,630,665 B2 12/2009 Ueno et al.
7,702,251 B2 4/2010 Miyabe et al.
7,720,408 B2 5/2010 Ueno et al.
7,813,668 B2 10/2010 Ueno et al.
7,945,185 B2 5/2011 Miyabe et al.
8,036,543 B2 10/2011 Yokomori et al.
8,155,554 B2 4/2012 Miyabe et al.
8,180,251 B2 5/2012 Nakamura et al.
8,229,320 B2 7/2012 Kimizuka et al.
8,233,821 B2 7/2012 Miyabe et al.
8,270,879 B2 9/2012 Numata et al.
8,275,283 B2 9/2012 Uneme et al.
8,275,286 B2 9/2012 Ueno et al.
8,280,278 B2 10/2012 Ueno et al.
8,295,734 B2 10/2012 Ueno et al.
8,326,178 B2 12/2012 Nakamura et al.
8,369,748 B2 2/2013 Ueno et al.
8,391,748 B2 3/2013 Miyabe et al.
8,401,441 B2 3/2013 Uneme et al.
8,422,914 B2 4/2013 Hayashi et al.
8,433,219 B2 4/2013 Miyabe et al.
8,452,210 B2 5/2013 Ueno et al.
8,494,399 B2 7/2013 Miyabe et al.
8,494,411 B2 7/2013 Miyabe et al.
8,521,060 B2 8/2013 Numata et al.
8,532,533 B2 9/2013 Ueno et al.
8,606,141 B2 * 12/2013 Furuya ..... G03G 21/1842 399/110
8,630,564 B2 1/2014 Ueno et al.
8,670,688 B2 3/2014 Ueno et al.
8,676,090 B1 3/2014 Ueno et al.
8,682,215 B1 3/2014 Ueno et al.
8,687,994 B2 4/2014 Nakamura et al.
8,874,004 B2 10/2014 Takasaka et al.
8,913,920 B2 12/2014 Nakamura et al.
9,052,638 B2 6/2015 Matsumaru et al.
9,069,289 B2 6/2015 Batori et al.
9,116,466 B2 8/2015 Makiguchi et al.
9,128,417 B2 9/2015 Yamasaki et al.
9,164,419 B2 10/2015 Uneme
9,164,424 B2 10/2015 Nakamura et al.
9,164,430 B2 10/2015 Murakami et al.
9,176,468 B2 11/2015 Ueno et al.
9,182,733 B2 11/2015 Horikawa et al.
9,188,906 B2 11/2015 Batori et al.
9,229,371 B2 1/2016 Murakami et al.
9,304,483 B2 4/2016 Komatsu et al.
9,354,552 B2 5/2016 Takeuchi
9,377,716 B2 6/2016 Yamasaki et al.
9,465,318 B2 10/2016 Takeuchi et al.
9,477,201 B2 10/2016 Miyabe et al.
9,494,890 B2 11/2016 Komatsu et al.
9,523,942 B2 12/2016 Takeuchi et al.
9,594,343 B2 3/2017 Miyabe et al.
9,599,932 B2 3/2017 Takeuchi et al.
9,678,471 B2 6/2017 Ueno et al.
9,684,261 B2 6/2017 Miyabe et al.
9,684,276 B2 6/2017 Sasaki et al.
9,684,279 B2 6/2017 Nakamura et al.
9,733,614 B2 8/2017 Ueno et al.
9,746,826 B2 8/2017 Ueno et al.
10,268,156 B2 * 4/2019 Takeuchi ..... G03G 21/1842
2004/0081483 A1 4/2004 Arimitsu
2006/0093399 A1 5/2006 Okabe et al.
2008/0138106 A1 6/2008 Kanno et al.
2008/0159772 A1 7/2008 Koishi et al.
2011/0038649 A1 2/2011 Miyabe et al.
2011/0076048 A1 3/2011 Uto et al.
2013/0055685 A1 3/2013 Itabashi
2013/0142538 A1 6/2013 Miwa et al.
2013/0243491 A1 9/2013 Nodera et al.
2013/0259537 A1 10/2013 Matsumoto et al.
2014/0169836 A1 6/2014 Nagashima et al.
2014/0321883 A1 10/2014 Nakazawa et al.
2015/0346670 A1 12/2015 Ueno et al.
2016/0274536 A1 9/2016 Ueno et al.
2017/0060033 A1 3/2017 Takeuchi et al.
2017/0090403 A1 3/2017 Morioka et al.
2017/0090406 A1 3/2017 Ueno et al.
2017/0090407 A1 3/2017 Ueno et al.
2017/0090408 A1 3/2017 Ueno et al.
2017/0090410 A1 3/2017 Ueno et al.
2017/0090411 A1 3/2017 Ueno et al.
2017/0090412 A1 3/2017 Morioka et al.
2017/0090413 A1 3/2017 Morioka et al.
2017/0090414 A1 3/2017 Ueno et al.
2017/0102634 A1 4/2017 Morioka et al.
2017/0139349 A1 5/2017 Miyabe et al.
2017/0168422 A1 6/2017 Takeuchi et al.
2017/0185027 A1 6/2017 Ueno et al.
2017/0185030 A1 6/2017 Morioka et al.
2017/0185031 A1 6/2017 Morioka et al.
2017/0185033 A1 6/2017 Ueno et al.
2017/0192384 A1 7/2017 Ueno et al.
2017/0192386 A1 7/2017 Ueno et al.
2017/0227919 A1 8/2017 Morioka et al.
2017/0227920 A1 8/2017 Morioka et al.
2017/0227925 A1 8/2017 Ueno et al.
2017/0227927 A1 8/2017 Ueno et al.
2017/0248909 A1 8/2017 Nakamura et al.
2017/0248911 A1 8/2017 Miyabe et al.
2017/0329279 A1 11/2017 Hirayama et al.
2018/0039226 A1 2/2018 Takeuchi et al.

FOREIGN PATENT DOCUMENTS

CN 103645619 A 3/2014
CN 103959176 A 7/2014
CN 104238316 A 12/2014
EP 1 653 299 A1 5/2006
JP 2001-138574 A 5/2001
JP 2005-106964 A 4/2005
JP 2008-268528 A 11/2008
JP 4815932 B2 11/2011
JP 2012-234200 A1 11/2012

(56) References Cited

FOREIGN PATENT DOCUMENTS

| | | | |
|---|---|---|---|
| JP | 5067913 | B2 | 11/2012 |
| JP | 2013-120235 | A | 6/2013 |
| JP | 2013-148875 | A | 8/2013 |
| JP | 2014-056012 | A | 3/2014 |
| JP | 2014-126586 | A | 7/2014 |
| JP | 2014-215479 | A | 11/2014 |
| KR | 10-2009-0080135 | A | 7/2009 |
| KR | 10-2011-033758 | A | 3/2011 |
| RU | 2 431 171 | C2 | 11/2007 |

OTHER PUBLICATIONS

International Preliminary Report on Patentability in International Patent Application No. PCT/JP2016/000957 (dated Sep. 8, 2017).
International Search Report and Written Opinion of the International Search Authority in International Patent Application No. PCT/JP2016/000957.
Office Action in Taiwanese Patent Application No. 105105460 (with English translation).
Office Action in Japanese Patent Application No. 2015-037953, dated Dec. 18, 2018.
Decision on Grant in Russian Patent Application No. 2017133425, dated May 8, 2018 (with English translation).
Feb. 26, 2019 Office Action in Korean Patent Application No. 10-2017-7026187.
Office Action in Chinese Patent Application No. 201680011314.9, dated Oct. 8, 2019 (with partial English translation).

* cited by examiner

PRIOR ART

CARTRIDGE, PROCESS CARTRIDGE, AND IMAGE FORMING APPARATUS

TECHNICAL FIELD

The present invention relates to an image forming apparatus using an electrophotographic system.

DESCRIPTION OF THE RELATED ART

Background Art

As image forming apparatuses such as a printer which form an image on a recording material using an electrophotographic image forming system (an electrophotographic process), there are image forming apparatuses in which a part of components involved in an image forming process is integrated as a process cartridge and configured to be attachable to and detachable from an apparatus main body (Japanese Patent No. 5067913 and Japanese Patent Application Laid-open No. 2012-234200). Examples of components made into a process cartridge include an electrophotographic photosensitive drum (hereinafter, a photosensitive body), charging means, developing means, and cleaning means. In addition, a process cartridge may sometimes be configured divided into a plurality of units such as a cleaning unit (a cleaning apparatus) including a photosensitive body and cleaning means, a developing unit including developing means, and a toner unit that supplies a developer.

A configuration in which such units or such a process cartridge is attached to and detached from an apparatus main body requires means for positioning the units or the like with respect to the apparatus main body. For example, a configuration is known in which a restricted portion that engages with a restricting portion provided on an apparatus main body is provided on a frame body of a unit or the like so as to restrict displacement in a guiding direction during mounting or at a mounting position (Japanese Patent No. 5067913 and Japanese Patent Application Laid-open No. 2012-234200). Meanwhile, with image formation, a surface of a photosensitive body after being charged is exposed by laser light to form an electrostatic image, and the electrostatic image is developed using a developer (toner) to be visually actualized as a developer image. Since exposing means for forming the electrostatic image is provided on an apparatus main body, the unit described above or the like must be configured not to obstruct an optical path of laser light that exposes the photosensitive body. In addition, an image forming apparatus that forms an image constituted by a plurality of colors such as a color printer is configured so that a plurality of process cartridges are arranged side by side in an apparatus main body.

SUMMARY OF INVENTION

Technical Problem

The following problems exist when a plurality of process cartridges are arranged side by side in a configuration in which laser light enters through a gap between a cleaning unit and a developing unit and exposes a photosensitive body.

For example, in a process cartridge shown in FIG. 9, a cleaning unit 113 is provided with a photosensitive drum 101 and a developing unit 104 is provided with a developing roller 117 and a developer housing chamber 104*a*. In addition, a guided portion 114*d* is provided on a cleaning frame body 114. The guided portion 114*d* has a protruded shape that extends in an axial direction of the photosensitive drum 101. The guided portion 114*d* engages with a recessed guide 150 provided on an apparatus main body when mounting the process cartridge to the main body to restrict contact movement in a vertically downward direction and in a horizontal direction.

At this point, laser light 103*a* enters through a gap between the cleaning unit 113 and the developing unit 104 and is irradiated onto the photosensitive drum 101. The laser light 103*a* and the cleaning unit 113 are arranged with a gap L1 provided therebetween. The gap L1 is set so that the laser light is not blocked even when dimension of parts vary and even when the parts are deformed. In addition, a wall 114*f* with a thickness L2 is provided on a side of the cleaning unit 113 with respect to the laser light 103*a*. Furthermore, the wall 114*f* and a developing unit 104R of an adjacent process cartridge are arranged with a gap L3 provided therebetween. The gap L3 is set so as not to be closed even when dimension of parts vary, the parts are deformed, or the developing unit 104 moves relative to the cleaning unit 113 as explained later.

In this case, in order to provide process cartridges with an increased toner capacity to be housed in the developer housing chamber 104*a* of the developing unit 104, either a distance between adjacent process cartridges or a height of the process cartridges must be increased. As a result, an overall size of the apparatus may increase. In recent years, there have been demands for extending product life of process cartridges for the purpose of reducing a replacement frequency of the process cartridges and, accordingly, there is a need for increasing toner capacity. On the other hand, there have been demands for reducing an apparatus installation space and reducing cost of an image forming apparatus. Accordingly, there is a need for downsizing the apparatus.

An object of the present invention is to provide a technique that enables downsizing of an image forming apparatus.

Solution to Problem

In order to achieve the above object of the present invention, the present invention provides a cartridge attachable to and detachable from an apparatus main body of an image forming apparatus that forms an image on a recording material, the cartridge comprising:

a photosensitive body; and a frame body that supports the photosensitive body and that includes a through hole through which light for exposing the photosensitive body can pass, wherein the through hole is configured such that a width of the through hole in a scanning direction in an irradiation range of the light for exposing the photosensitive body becomes greater toward a side of the photosensitive body from a side of a light source of light for exposing the photosensitive body.

In order to achieve the above object of the present invention, the present invention provides a cartridge attachable to and detachable from an apparatus main body of an image forming apparatus that forms an image on a recording material, the cartridge comprising:

a photosensitive body; and a frame body which supports the photosensitive body and which includes a first restricted portion that is restricted by a first restricting portion provided in the apparatus main body and a second restricted portion that is provided on a side opposite to the first restricting portion across an optical path of light for exposing the photosensitive body and that is restricted by a second restricting portion provided in the apparatus main body.

In order to achieve the above object of the present invention, the present invention provides a process cartridge that is attachable to and detachable from an apparatus main body of an image forming apparatus, the process cartridge comprising:

the cartridge; and a developing cartridge provided with a developer bearing member that bears a developer for developing an electrostatic image formed on the photosensitive body.

Moreover, in order to achieve the above object of the present invention, the present invention provides an image forming apparatus forming an image on a recording material, wherein either the cartridge or the process is configured in plurality to be attachable to and detachable from an apparatus main body.

Further features of the present invention will become apparent from the following description of exemplary embodiments with reference to the attached drawings.

DESCRIPTION OF EMBODIMENTS

Modes for implementing the present invention will now be exemplarily described in detail based on embodiments with reference to the drawings. It is to be understood that dimensions, materials, shapes, relative arrangements, and the like of components described in the embodiments are intended to be changed as deemed appropriate in accordance with configurations and various conditions of apparatuses to which the present invention is to be applied. In other words, the scope of the present invention is not intended to be limited to the embodiments described below.

Embodiments (Electrophotographic Image Forming Apparatus)

Figure 2:
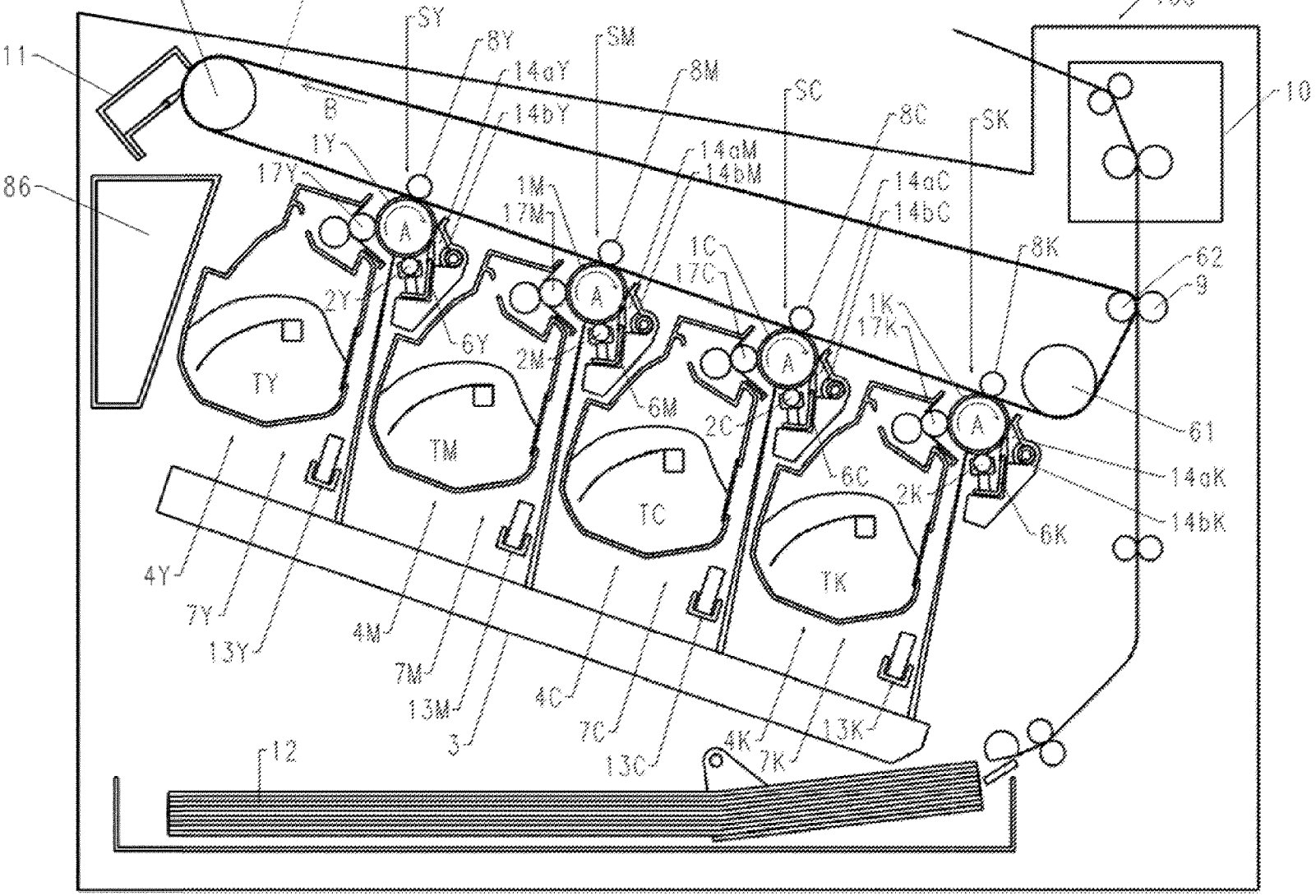
FIG. 2 is a schematic sectional view showing an electrophotographic image forming apparatus according to the present embodiment.

An overall configuration of an embodiment of an electrophotographic image forming apparatus (hereinafter, also simply referred to as an "image forming apparatus") according to the present invention will be described with reference to FIG. 2. FIG. 2 is a schematic sectional view of an image forming apparatus 100 according to an embodiment of the present invention. In this case, an electrophotographic image forming apparatus refers to an apparatus that forms an image on a recording material (recording medium) using an electrophotographic image forming system. Examples of an image forming apparatus include a copier, a printer (such as a laser beam printer or an LED printer), a facsimile device, a word processor, or a multifunctional machine (a multifunctional printer) that combines these devices. Examples of a recording material include recording paper and a plastic sheet.

As a plurality of image forming portions, the image forming apparatus 100 includes first, second, third, and fourth image forming portions SY, SM, SC, and SK for respectively forming images of the colors of yellow (Y), magenta (M), cyan (C), and black (K). In the present embodiment, configurations and operations of the first to fourth image forming portions are substantially the same with the exception of differences in colors of the formed images. Therefore, unless the image forming portions must be distinguished from one another, Y, M, C, and K will be omitted and the image forming portions will be collectively described. In other words, in the present embodiment, the image forming apparatus 100 includes photosensitive drums (or photosensitive body) 1 (1Y, 1M, 1C, and 1K) as four image bearing members. The photosensitive drum 1 rotates in a direction of an arrow A in FIG. 2, and a charging rollers 2 and a scanner unit (an exposing apparatus) 3 are arranged around the photosensitive drum 1.

In this case, the charging rollers 2 (2Y, 2M, 2C, and 2K) are charging means that uniformly charge a surface of the photosensitive drum 1. In addition, the scanner unit 3 is exposing means which irradiates a laser based on image information and forms an electrostatic image (an electrostatic latent image) on the photosensitive drum 1. Developing assemblies (hereinafter, developing units) 4 (4Y, 4M, 4C, and 4K) and cleaning blades 6 (6Y, 6M, 6C, and 6K) as cleaning means are arranged in a periphery of the photosensitive drums 1. Furthermore, an intermediate transfer belt 5 as an intermediate transfer member for transferring a toner image on the photosensitive drum 1 to a recording material 12 is arranged so as to oppose the four photosensitive drums 1. In addition, the developing units 4 use non-magnetic single component toners or, in other words, toners T (TY, TM, TC, and TK) as developers. In the present embodiment, the developing units 4 perform contact development by bringing developing rollers 17 (7Y, 7M, 7C, and 7K) as developer bearing members into contact with the photosensitive drum 1. The cleaning units 13 (13Y, 13M, 13C, and 13K) include the photosensitive drums 1, the charging rollers 2, and the cleaning blades 6. In addition, the cleaning unit 13 include removed developer housing portions (hereinafter, referred to as removed toner housing portions) 14*a* (14*a*Y, 14*a*M, 14*a*C, and 14*a*K) which house untransferred toner (removed toner) that remains on the photosensitive drums 1.

The process cartridge 7 is configured such that the developing unit 4 (developing cartridge) and the cleaning unit 13 (cleaning apparatus) are organized into an integrated cartridge. The image forming apparatus 100 according to the present embodiment is configured such that a plurality of the process cartridges 7 constituted by the developing units 4 and the cleaning units 12 are attachable to and detachable from the image forming apparatus 100. The process cartridge 7 is configured to be attachable to and detachable from the image forming apparatus 100 via mounting means such as a mounting guide or a positioning member (not shown) provided on the image forming apparatus 100. In other words, in the present embodiment, elements constituting the image forming apparatus 100 with the exception of elements constituting the process cartridge 7 constitute an apparatus main body. The process cartridges 7 for the respective colors all have the same shape. The process cartridges 7 for the respective colors house toners T (TY, TM, TC, and TK) of the respective colors of yellow (Y), magenta (M), cyan (C), and black (K).

The intermediate transfer belt 5 is in contact with all photosensitive drums 1 and rotates in a direction of an arrow B in FIG. 2. The intermediate transfer belt 5 is stretched over a plurality of supporting members (a driver roller 61, a secondary transfer opposing roller 62, and a driven roller 63). Four primary transfer rollers 8 (8Y, 8M, 8C, and 8K) as primary transfer means are arranged side by side on a side of an inner peripheral surface of the intermediate transfer belt 5 so as to oppose the respective photosensitive drums 1. A secondary transfer roller 9 as secondary transfer means is arranged at a position opposing the secondary transfer opposing roller 62 on a side of an outer peripheral surface of the intermediate transfer belt 5.

(Image Forming Process)

During image formation, first, the surface of the photosensitive drum 1 is uniformly charged by the charging roller 2. Next, due to laser light in accordance with image information transmitted from the scanner unit 3, the charged surface of the photosensitive drum 1 is subjected to scanning exposure and an electrostatic latent image in accordance with the image information is formed on the photosensitive drum 1. The electrostatic latent image formed on the photosensitive drum 1 is developed by the developing unit 4 as a toner image. The toner image formed on the photosensitive drum 1 is transferred (primarily transferred) onto the intermediate transfer belt 5 by an action of the primary transfer roller 8.

For example, when forming a full-color image, the process described above is sequentially performed by the first to fourth image forming portions SY, SM, SC, and SK, and toner images of the respective colors are primarily transferred onto the intermediate transfer belt 5 by being sequentially superimposed on one another. Subsequently, the recording material 12 is conveyed to the secondary transfer portion in synchronization with a movement of the intermediate transfer belt 5. In addition, due to an action of the secondary transfer roller 9 in contact with the intermediate transfer belt 5 via the recording material 12, the four-color toner image on the intermediate transfer belt 5 is collectively secondarily transferred onto the recording material 12. The recording material 12 onto which the toner image has been transferred is conveyed to a fixing apparatus 10 as fixing means. Heat and pressure are applied to the recording material 12 at the fixing apparatus 10 to fix the toner image onto the recording material 12.

Primary transfer residual toner that remains on the photosensitive drum 1 after the primary transfer process is removed by the cleaning blade 6. In addition, secondary transfer residual toner that remains on the intermediate transfer belt 5 after the secondary transfer process is removed by an intermediate transfer belt cleaning apparatus 11. The removed transfer residual toner (removed toner) is discharged to a removed toner box 86 of the image forming apparatus 100. A method of conveying removed toner will be described later.

The image forming apparatus 100 is also configured to form a single-color image or a multi-color image using only a single or some (not all) desired image forming portions.

(Process Cartridge)

Figure 1:
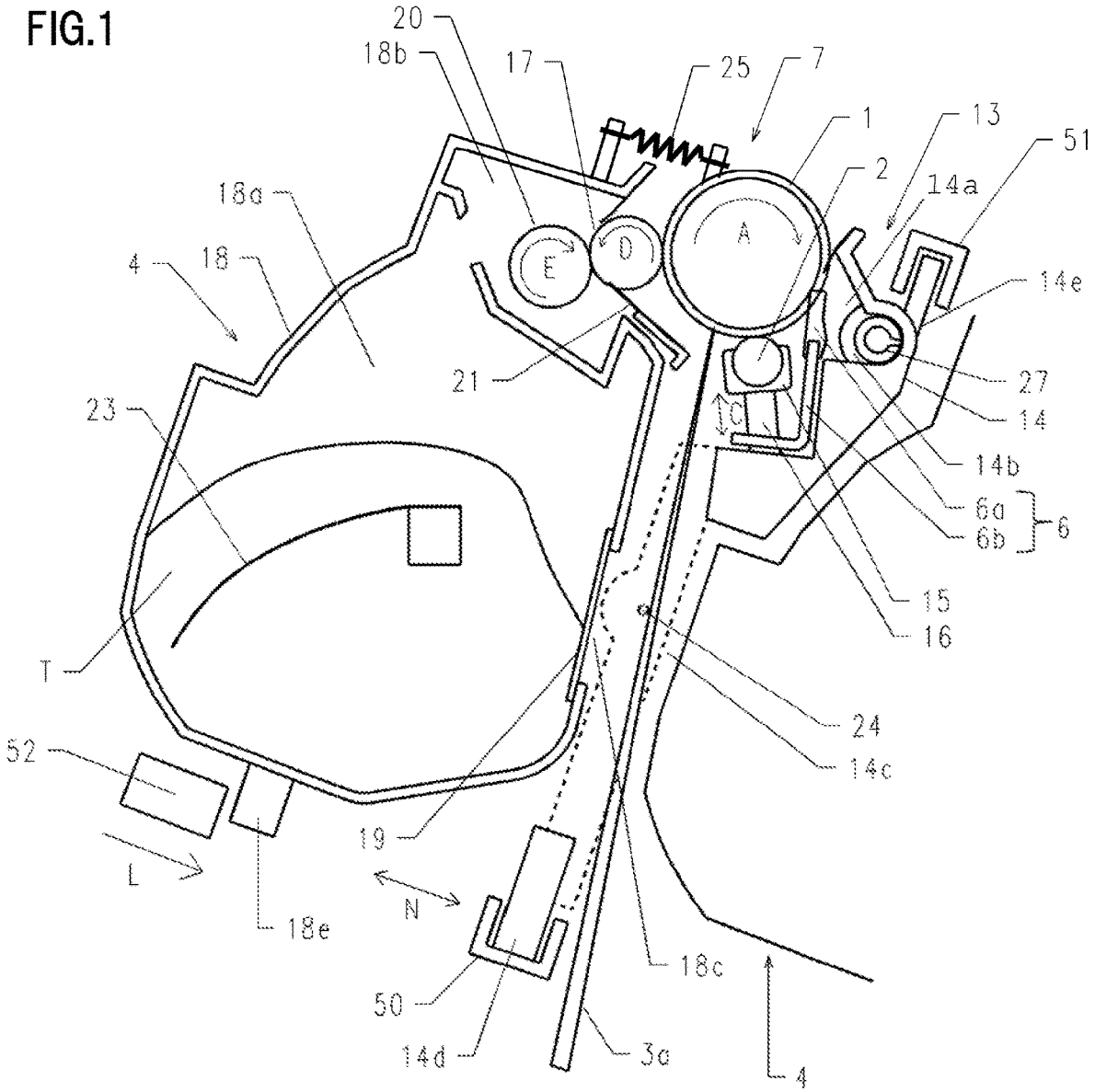
FIG. 1 is a schematic sectional view showing a process cartridge and a main body according to a present embodiment.
Figure 3:
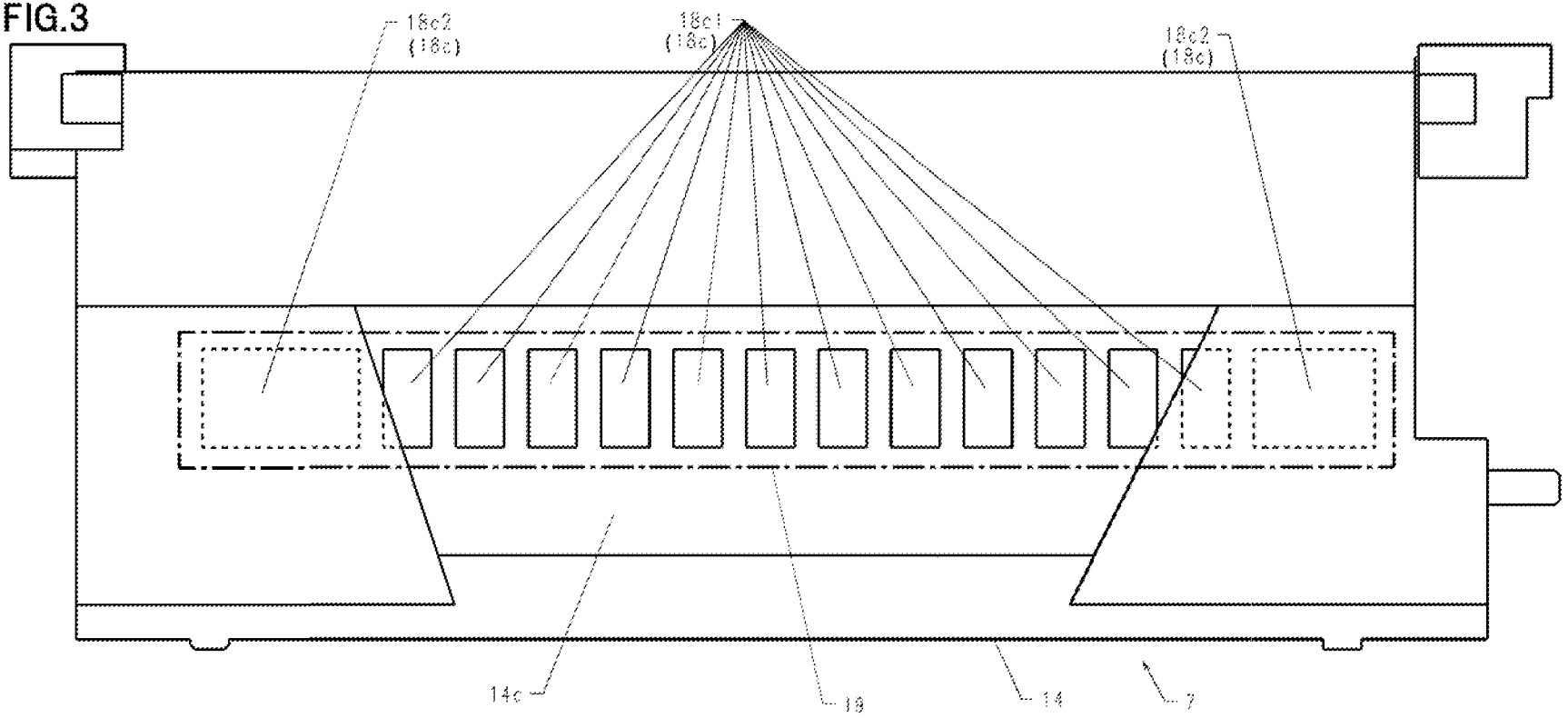
FIG. 3 is a side view showing a process cartridge according to the present embodiment.

An overall configuration of the process cartridge 7 to be mounted to the image forming apparatus 100 according to the present embodiment will now be described with reference to FIGS. 1 and 3. FIG. 1 is a schematic sectional view showing a process cartridge and a part of an apparatus main body. FIG. 3 is a side view showing a process cartridge.

As shown in FIG. 1, the developing unit 4 includes a developing frame body 18 that supports the various elements in the developing unit 4. The developing unit 4 is provided with a developing roller 17 as a developer bearing member which bears toner (developer) and which comes into contact with the photosensitive drum 1 and rotates in a direction of an arrow D in FIG. 1 (a counterclockwise direction). The developing roller 17 is rotatably supported at both ends in a longitudinal direction thereof (a direction of a rotational axis thereof) by the developing frame body 18 via bearings. In addition, the developing frame body 18 (the developer housing portion) includes a developer storage chamber (hereinafter, a toner housing chamber) 18*a* (housing chamber) and a developing chamber 18*b* in which the developing roller 17 is arranged. A toner supplying roller 20 as a developer supplying member which comes into contact with the developing roller 17 and rotates in a direction of an arrow E and a developing blade 21 as a developer restricting member for restricting a toner layer of the developing roller 17 are arranged in the developing chamber 18*b*. Furthermore, a stirring member 23 for stirring toner T housed in the toner storage chamber 18*a* of the developing frame body 18 and for conveying the toner to the toner supplying roller 20 is provided in the toner storage chamber 18*a*.

A vent hole 18*c* for preventing a rise in internal pressure of the toner housing chamber 18*a* or for degassing during toner injection is provided on an outer wall on a side of the cleaning unit 13 of a wall portion of the developing frame body 18 which constitutes the toner housing chamber 18*a*. A ventilation member (filter) 19 is provided so as to block the vent hole 18*c*. The ventilation member 19 prevents passage of the toner T but allows passage of air. The ventilation member 19 is bonded to the developing frame body 18 by adhesion, welding, insert molding, or the like. By configuring a periphery of the vent hole 18*c* as a flat surface, bonding of the ventilation member 19 to the developing frame body 18 can be readily performed and adhesiveness with a degassing apparatus (not shown) can be improved when degassing is performed during toner injection.

As shown in FIG. 3, the vent hole 18*c* is arranged in plurality in a longitudinal direction. A single rectangular ventilation member 19 is provided with respect to the plurality of vent holes 18*c* so as to block all of the vent holes 18*c*. An opening 14*c* that is a through hole is provided on the cleaning unit 13 as will be described later. The vent hole 18*c* has a rectangular shape and is provided in plurality. When viewed from a side of the cleaning unit 13, an area of the hole is small in a region overlapping (exposed to an exterior)

the opening 14*c* (18*c*1) and is large in a region not overlapping the opening 14*c* (18*c*2). Accordingly, ventilation performance can be improved while securing a large vent hole area as possible and, at the same time, separation of the ventilation member 19 due to being touched by a user during handling can be prevented. While the vent hole 18*c* is given a rectangular shape and is provided in plurality in the present embodiment, the vent hole 18*c* may have any shape and only one vent hole 18*c* may be provided. Moreover, the present invention can also be applied to a configuration in which the ventilation member 19 and the vent hole 18*c* are not provided.

As shown in FIG. 1, the developing unit 4 is coupled to the cleaning unit 13 so as to be rotationally movable around a fitting shaft 24 that is fixed to and supported by a cleaning frame body 14. In addition, the developing unit 4 is biased by a pressure spring (tension spring) 25. Therefore, during image formation by the process cartridge 7, the developing unit 4 rotates around the fitting shaft 24 and the photosensitive drum 1 and the developing roller 17 come into contact with each other. Furthermore, a pressed portion 18*e* is provided on the developing unit 4. A separation lever 52 is provided on the apparatus main body. When image formation is not being performed, as the main body separation lever 52 presses the pressed portion 18*e* and moves in a direction of an arrow L, the developing unit 4 rotates around the fitting shaft 24 and the photosensitive drum 1 and the developing roller 17 separate from each other. While the developing unit 4 is configured to be rotatable with respect to the cleaning unit 13 in the present embodiment, this configuration is not restrictive and the present invention can also be applied to a configuration in which the developing unit 4 slides or to a configuration in which the developing unit 4 does not move.

(Cleaning Unit)

The cleaning unit 13 includes the cleaning frame body 14 as a frame body that supports the various elements in the cleaning unit 13. The cleaning frame body 14 is attached (supported) via a bearing member so that the photosensitive drum 1 is rotatable in a direction of an arrow A shown in FIG. 1. In addition, a charging roller bearing 15 is attached to the cleaning frame body 14 along a line that passes through a center of rotation of the charging roller 2 (charging member) and a center of rotation of the photosensitive drum 1. In this case, the charging roller bearing 15 is attached so as to be movable in a direction of an arrow C shown in FIG. 1. The charging roller 2 is rotatably attached to the charging roller bearing 15. In addition, the charging roller bearing 15 is biased toward the photosensitive drum 1 by a charging roller pressure spring 16 as biasing means. Furthermore, the cleaning blade 6 is integrally formed by an elastic member 6*a* for removing transfer residual toner (removed toner) that remains on the surface of the photosensitive drum 1 after primary transfer and a supporting member 6*b* for supporting the elastic member. Removed toner as a removed object having been removed from the surface of the photosensitive drum 1 by the cleaning blade 6 drops in a direction of gravity (vertical direction) in a space formed by the cleaning blade 6 and the cleaning frame body 14 and is housed in the removed toner housing portion 14*a*. The removed toner housing portion 14*a* is provided with conveyance paths 14*b* (14*b*Y, 14*b*M, 14*b*C, and 14*b*K) for conveying removed toner housed in the removed toner housing portion 14*a*, and a conveyance screw 27 is arranged in the conveyance paths 14*b*. The conveyance screw 27 is arranged such that an axial direction thereof is parallel to an axial direction of the photosensitive drum 1.

Figure 4:
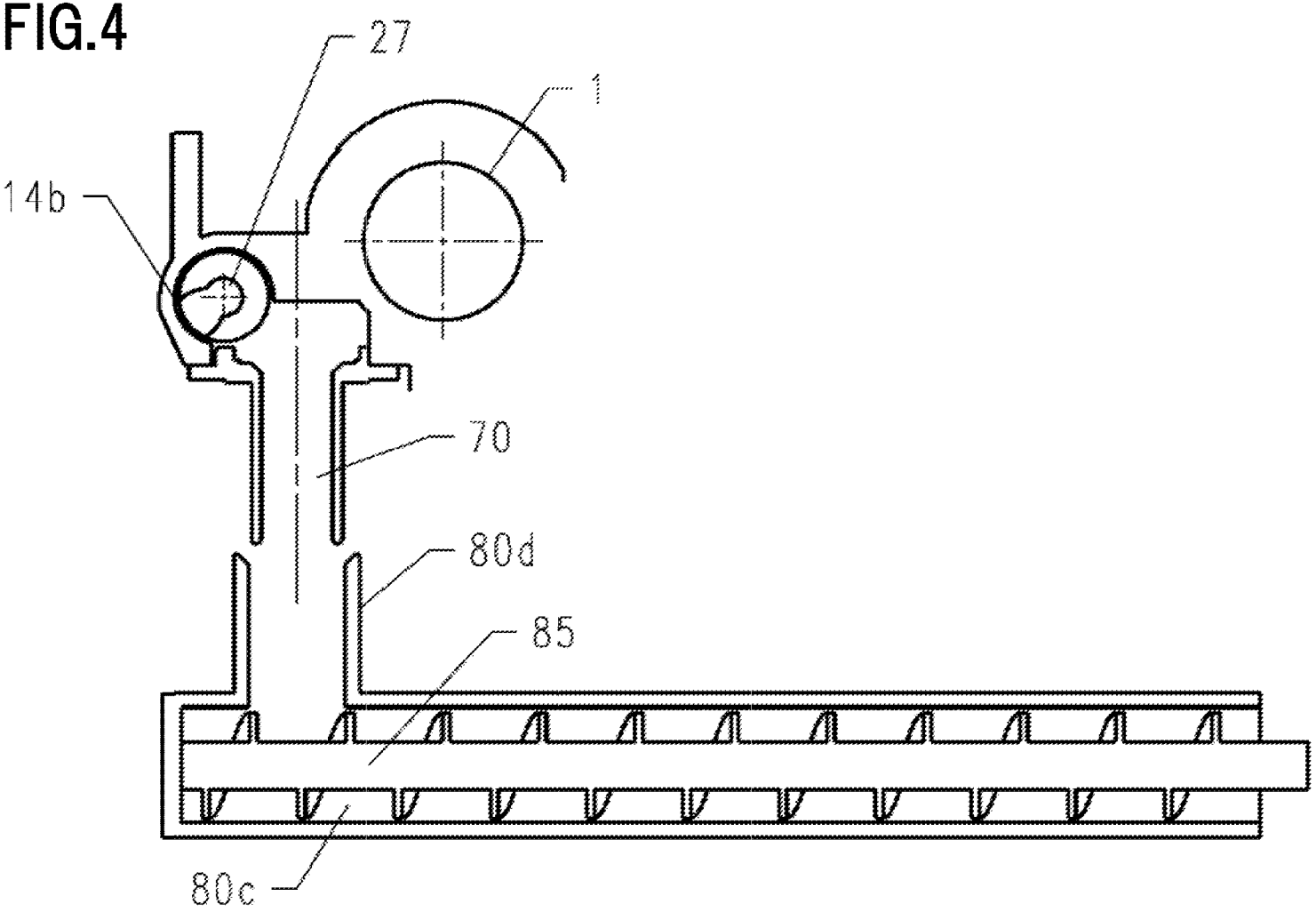
FIG. 4 is a schematic sectional view showing a process cartridge and a main body conveying portion according to a present embodiment.
Figure 5:
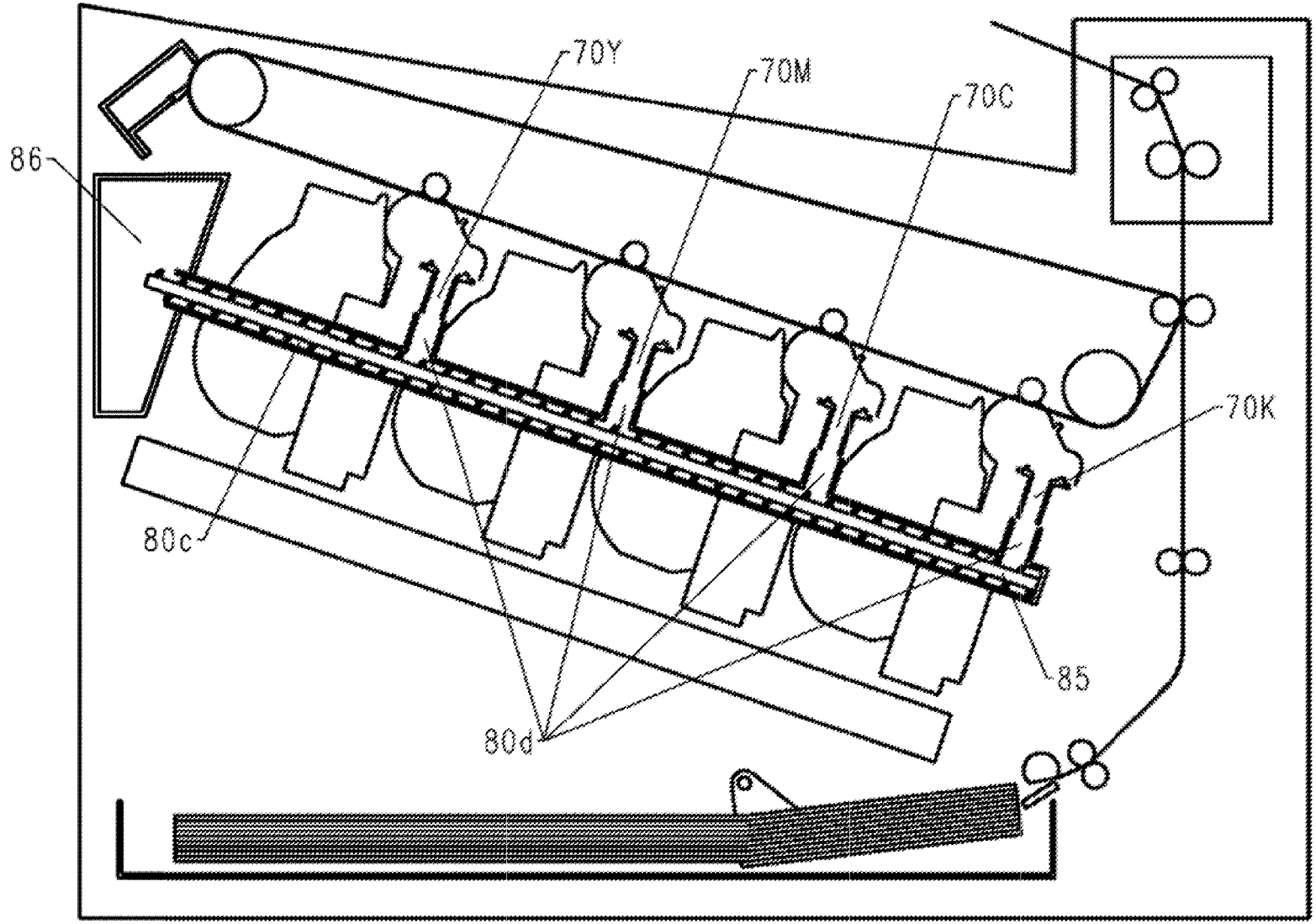
FIG. 5 is a schematic sectional view showing a process cartridge and a main body conveying portion according to a present embodiment.

As shown in FIG. 4, a second conveyance path 70 which extends vertically with respect to a conveyance direction of the conveyance path 14*b* and in a direction of gravity and through which removed toner passes is arranged at a downstream-side end of the conveyance path 14*b* in a conveyance direction of removed toner. FIG. 4 is a diagram for explaining a configuration for collecting a removed object according to the present embodiment and is a schematic sectional view showing a toner process cartridge and a main body conveying portion. Removed toner is conveyed in an axial direction by the conveyance screw 27 (conveying member) from the removed toner housing portion 14*a*. The removed toner then exits the cleaning unit 13 from a discharge port of the second conveyance path 70 and is discharged to an inflow port 80*d* of a main body main conveyance path 80*c* provided in the apparatus main body. Subsequently, as shown in FIG. 5, the removed toner is conveyed to the removed toner box 86 by a main body conveyance screw 85 provided in the main body main conveyance path 80*c* to be housed in the removed toner box 86. FIG. 5 is a diagram for explaining a configuration for collecting a removed object according to the present embodiment and is a schematic sectional view showing a toner process cartridge and a main body conveying portion. While the present embodiment adopts a configuration in which removed toner collected by the process cartridge 7 is conveyed to the main body to be housed in the removed toner box 86, this configuration is not restrictive. For example, the present invention can also be applied to a configuration in which removed toner is conveyed to the developing unit 4 or a configuration in which removed toner is not conveyed.

(Attachment and Detachment of Process Cartridge)

Figure 6:
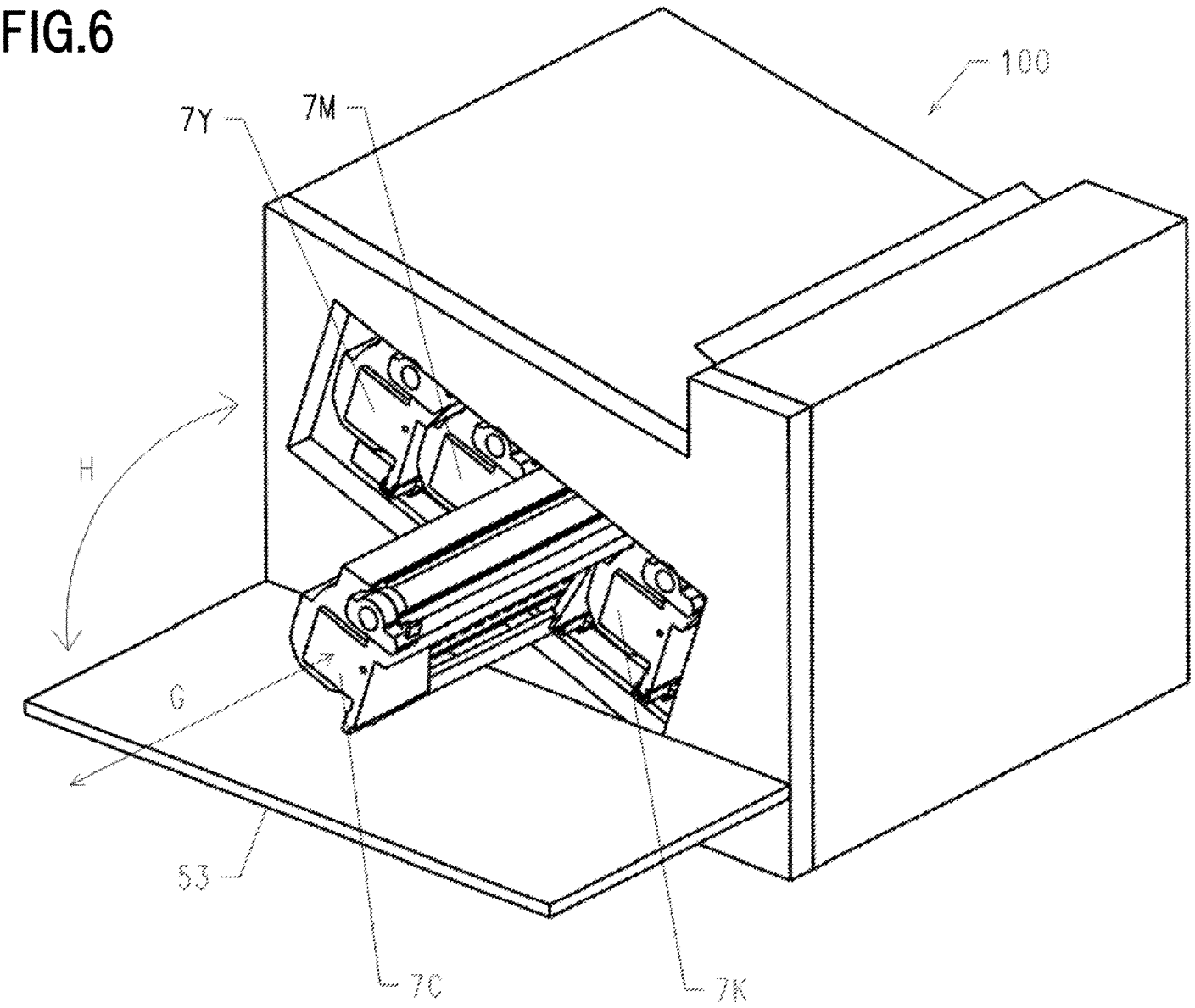
FIG. 6 is a perspective view showing a process cartridge and a configuration for attaching and detaching a process cartridge to and from a main body according to a present embodiment.
Figure 7:
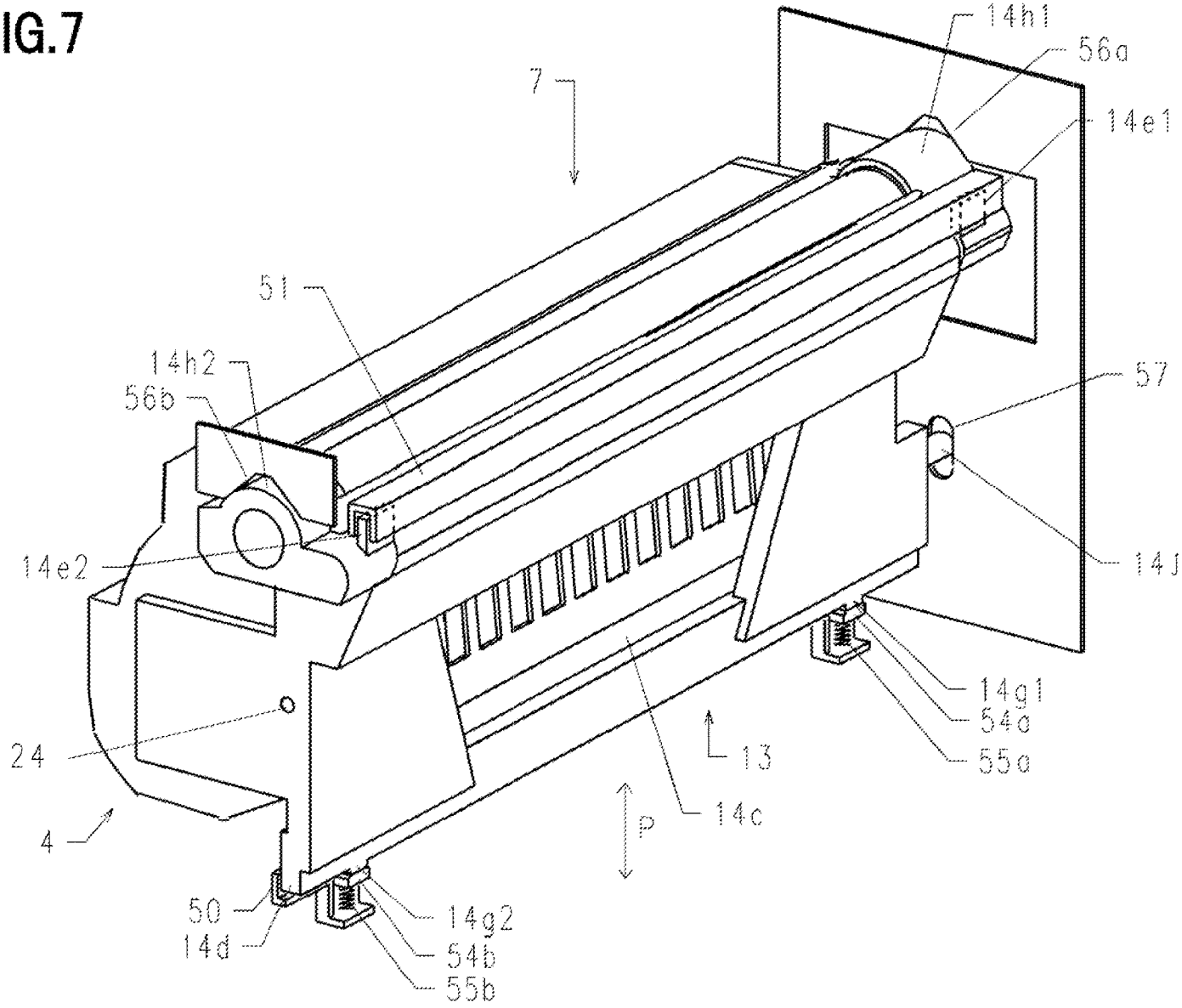
FIG. 7 is a schematic perspective view showing a process cartridge and a configuration for positioning a process cartridge with respect to a main body according to a present embodiment.

A configuration for attaching and detaching the process cartridge 7 with respect to the apparatus main body will now be described with reference to FIGS. 1, 6, and 7. FIG. 6 is a perspective view showing a process cartridge and a configuration for attaching and detaching a process cartridge to and from a main body. FIG. 7 is a schematic perspective view showing a configuration for positioning a process cartridge with respect to a main body.

As shown in FIG. 6, the process cartridge 7 is attached and detached in an axial direction (a direction of an arrow G) of the photosensitive drum 1 with respect to the main body 100. In this case, an upstream side in a mounting direction of the process cartridge 7 will be defined as a front side and a downstream side in the mounting direction of the process cartridge 7 will be defined as a rear side. In addition, as shown in FIG. 1, a first guide 50 which extends in an attaching/detaching direction and which has a recessed shape is provided on a lower side in a vertical direction of the main body 100, and a second guide 51 which has a recessed shape is provided on an upper side in a vertical direction of the main body 100. Meanwhile, as shown in FIGS. 7 and 1, a first guided portion 14*d* (first restricted portion) which extends in an axial direction of the photosensitive drum 1 and which has a protruded shape is provided at a position corresponding to the first guide 50 (first restricting portion) on the cleaning frame body 14 of the cleaning unit 13. Furthermore, second guided portions 14*e* (14*e*1 and 14*e*2) which have a protruded shape are provided at both longitudinal ends of a position corresponding to the second guide 51 (second restricting portion) of the cleaning frame body 14. Moreover, in FIG. 7, the first guide 50 is shown with a part of a structure thereof removed in order to present a structure of the first guided portion 14*d* in an easily understandable manner. As contact of the first guided portion 14*d* and the second guided portions 14*e*1 and 14*e*2 with respect to the first guide 50 and the second guide 51 is respectively restricted, postures of the process cartridge 7 in a vertical direction and a horizontal direction during attaching and detaching are restricted. In other words, the first guided portion 14*d* and the second guided portions 14*e* are restricted by the first guide 50 and the second guide 51 so that movement in a movement direction of the process cartridge 7 is allowed but movement in directions other than the movement direction is restricted during attachment to and detachment from the apparatus main body.

While the first guide 50 and the second guide 51 are given recessed shapes and the first guided portion 14*d* and the second guided portions 14*e*1 and 14*e*2 are given protruded shapes in the present embodiment, this configuration is not restrictive. For example, the first guide 50 and the second guide 51 may be given protruded shapes and the first guided portion 14*d* and the second guided portions 14*e*1 and 14*e*2 may be given recessed shapes. In addition, while the first guided portion 14*d* is configured to extend along the entire attaching/detaching direction, this configuration is not restrictive. For example, the first guided portion 14*d* may be configured to extend only at both longitudinal ends or may be configured to extend at only one location in the longitudinal direction. In a similar manner, while the second guided portions 14*e*1 and 14*e*2 are configured to extend only at both longitudinal ends along the entire attaching/detaching direction, this configuration is not restrictive. For example, the second guided portions 14*e*1 and 14*e*2 may be configured to extend along the entire attaching/detaching direction or may be configured to extend at only one location in the longitudinal direction.

In addition, the separation lever 52 described earlier is provided on the main body 100 (refer to FIG. 1). In a state where the process cartridge 7 is mounted to the main body 100, the separation lever 52 is biased in a direction of an arrow L and is at a separation position that causes the photosensitive drum 1 and the developing roller 17 to be separated from each other. On the other hand, the process cartridge 7 is in a contact state where the photosensitive drum 1 and the developing roller 17 are in contact with each other in a state prior to mounting. As described above, during a mounting process of the process cartridge 7, the separation lever 52 and the pressed portion 18*e* provided on the developing unit 4 come into contact with each other and the pressed portion 18*e* is separated by the separation lever 52. In addition, the developing unit 4 rotates around the fitting shaft 24 with respect to the cleaning unit 13 to cause the photosensitive drum 1 and the developing roller 17 to separate from each other in a state where mounting has been completed and to release biasing of the separation lever 52 and cause the photosensitive drum 1 and the developing roller 17 to come into contact with each other during image formation. The developing unit 4 moves with respect to the cleaning unit 13 during an attaching/detaching process. Therefore, by providing a guided section during attachment and detachment of the process cartridge 7 on the cleaning unit 13 instead of on the developing unit 4, the posture of the process cartridge 7 during attachment and detachment stabilizes and operability improves.

(Positioning of Process Cartridge)

Next, a configuration for positioning the process cartridge 7 will now be described with reference to FIGS. 6 and 7. The first guide 50 provided on the apparatus main body is configured to move in an up/down direction (a direction of an arrow P in FIG. 7) in conjunction with an opening/closing operation (a direction of an arrow H in FIG. 6) of a main body door 53. The first guide 50 is moved to a lower position in an opened state of the main body door 53 and moved to an upper position in a closed state of the main body door 53 by a link mechanism (not shown) or the like. As shown in FIG. 7, pressing members 54*a* and 54*b* are respectively provided on a rear side and a front side of the first guide 50. The pressing members 54*a* and 54*b* are slidable in an up/down direction (the direction of the arrow P in FIG. 7) of the first guide 50 and are biased in an upward direction by biasing means 55*a* and 55*b* that are compression springs or the like. In addition, V-shaped positioning portions 56*a* and 56*b* are respectively provided on a rear side and a front side of the apparatus main body. Furthermore, a hole portion 57 which extends in a direction of upward/downward movement of the first guide 50 and which has a long, round hole shape is provided on the rear side.

Meanwhile, the process cartridge 7 is respectively provided with receiving portions 14*g*1 and 14*g*2 on a rear side and a front side of the cleaning unit 13. In addition, R-shaped restricting portions 14*h*1 and 14*h*2 are respectively provided on the rear side and the front side of the cleaning unit 13. Furthermore, a cylindrical rotation-preventing boss 14*j* is provided on the rear side of the cleaning unit 13. As described earlier, when the process cartridge 7 is mounted in an axial direction of the photosensitive drum 1, the rotation-preventing boss 14*j* of the cleaning unit 13 is fitted to the main body hole portion 57. Next, due to a closing operation of the main body door 53, the first guide 50 is moved to the upper position. At this point, the pressing members 54*a* and 54*b* press the receiving portions 14*g*1 and 14*g*2 upward due to biasing forces of the biasing means 55*a* and 55*b*. In addition, due to the restricting portions 14*h*1 and 14*h*2 of the cleaning unit 13 abutting against the positioning portions 56*a* and 56*b* of the main body 100 and the rotation-preventing boss 14*j* engaging with the hole portion 57, a position of the process cartridge 7 with respect to the main body 100 is determined.

(Opening of Cleaning Unit)

As shown in FIG. 1, in the cleaning unit 13, between a center of the photosensitive drum 1 and the first guided portion 14*d*, the cleaning frame body 14 is provided with the opening 14*c* through which the laser light 3*a* for exposing the photosensitive drum 1 can pass. The opening 14*c* is provided in a direction in which the cleaning unit 13 and the developing unit 4 oppose each other (a direction of an arrow N in FIG. 1).

As described earlier, due to laser light 3*a* in accordance with image information transmitted from the scanner unit 3, an electrostatic latent image in accordance with the image information is formed on the photosensitive drum 1. During image formation, the laser light 3*a* passes through the opening 14*c* and is irradiated on the photosensitive drum 1. In this case, the first guided portion 14*d* is arranged on the side of the developing unit 4 so as to straddle the laser light 3*a*. In other words, the cleaning frame body 14 includes a portion on a side far from the photosensitive drum 1 (a first frame body portion) and a portion on a side close to the photosensitive drum 1 (a second frame body portion) approximately across the opening 14*c*, and the first guided portion 14*d* is provided in the first frame body portion. The second guided portions 14*e*1 and 14*e*2 are provided in the second frame body portion. The cleaning frame body 14 is configured to include a portion in which the first guided portion 14*d* is provided, a portion in which the second guided portions 14*e*1 and 14*e*2 are provided, and a connecting portion which connects the two portions across an optical path of the laser light 3*a*. The first frame body portion and the second frame body portion are positioned so as to sandwich the optical path of the laser light 3*a*, and the first frame body portion is positioned on a same side as the developing unit 4 with respect to the optical path of the laser light 3*a*. In addition, the first frame body portion is positioned on an opposite side across the optical path of the laser light 3*a* with respect to the developing unit 4 of an adjacent process cartridge 7 (another developing cartridge).

As described above, by adopting a configuration in which the opening 14*c* is provided and the cleaning frame body 14 has a shape that sandwiches the optical path of the laser light 3*a*, a frame body dimension in a direction in which the process cartridges 7 are adjacent to each other can be reduced. In other words, a width of the process cartridge 7 in a direction in which the cleaning unit 13 and the developing unit 4 oppose each other (a direction in the arrow N in FIG. 1) can be reduced at the opening 14*c* and in a region where the opening 14*c* is separated from the center of the photosensitive drum 1. In addition, as shown in FIG. 1, by arranging a part of the developing units 4 of adjacent process cartridges 7 in the downsized region described above, necessary toner housing capacity can be secured and a distance between adjacent process cartridges 7 or a height of the developing units can be reduced. Therefore, the process cartridges 7 can be downsized and adjacent intervals of the process cartridges 7 that are adjacent to each other can be reduced. Accordingly, a reduction in mounting spaces of the plurality of process cartridges 7 in the apparatus main body can be performed and downsizing of the apparatus can be achieved.

Figure 8:
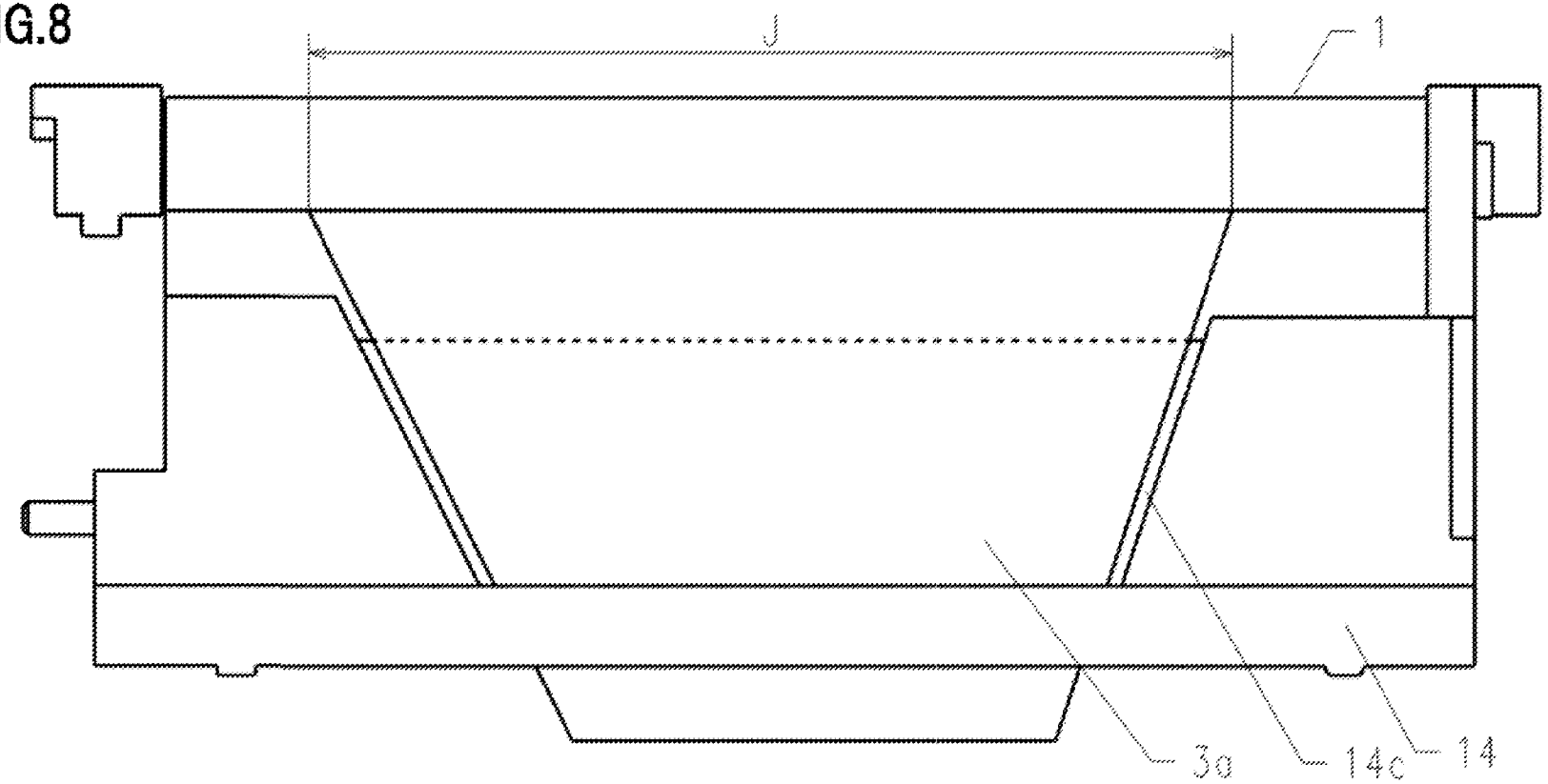
FIG. 8 is a schematic side view showing a process cartridge according to the present embodiment.
Figure 9:
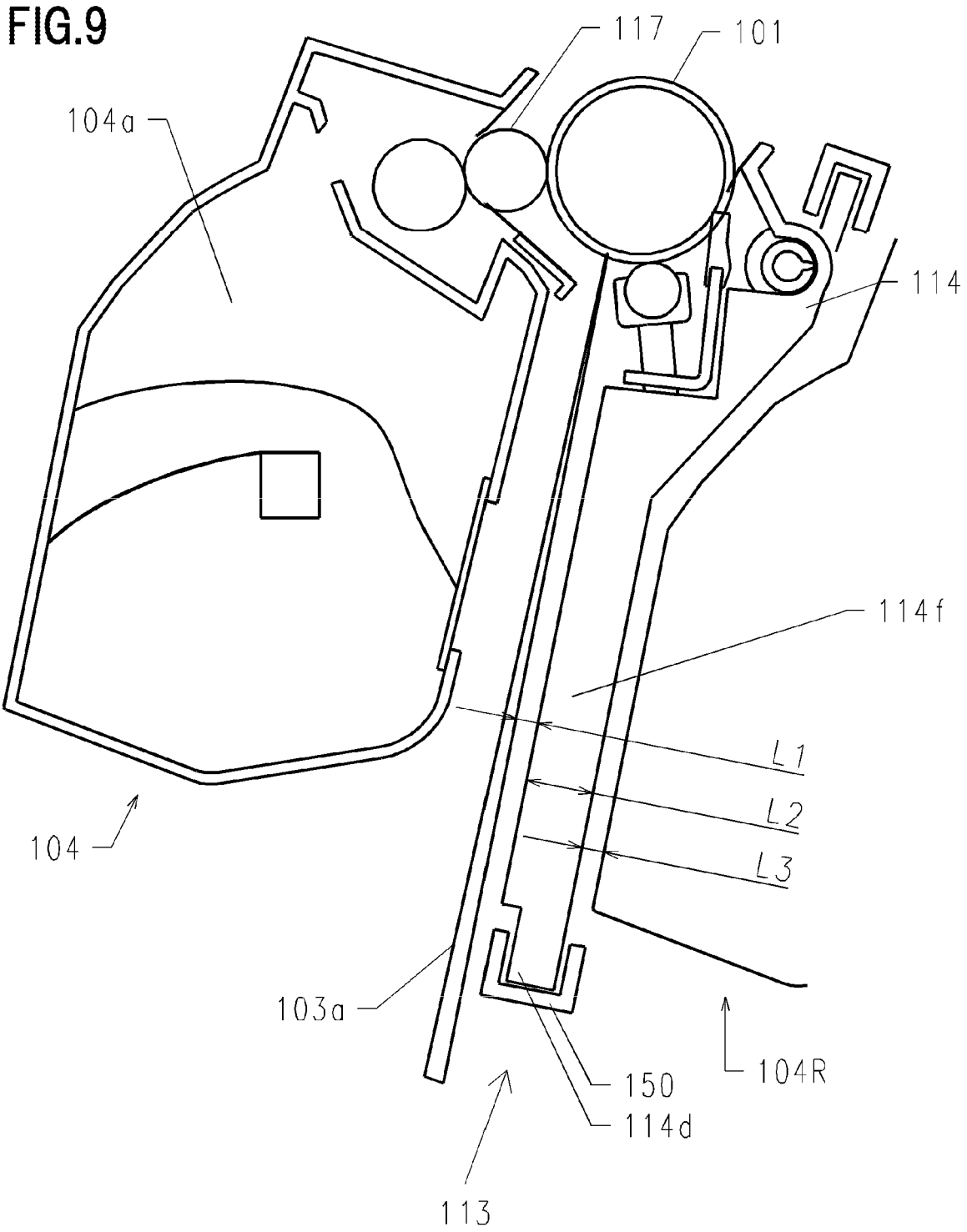
FIG. 9 is a schematic sectional view showing a process cartridge and a main body for explaining a conventional example.

As shown in FIG. 8, the opening 14*c* has a trapezoidal shape when viewed from a direction in which the cleaning unit 13 and the developing unit 4 oppose each other (the direction of the arrow N in FIG. 1). This is a shape that enables the laser light 3*a* to be irradiated in a printable region J on the photosensitive drum 1. In other words, the opening 14*c* is configured so that the width of the opening 14*c* in a scanning direction in an irradiation range of the laser light 3*a* becomes greater gradually toward a side of the photosensitive drum 1 from a side of a light source of the laser light 3*a*. Accordingly, a size of the connecting portion which connects a portion on one side and a portion on the other side of the opening 14*c* of the cleaning frame body 14 can be secured and strength of the frame body can be secured while ensuring that the optical path of the laser light 3*a* is not obstructed. Moreover, while the opening 14*c* is given a trapezoidal shape in the present embodiment, this is not restrictive. The opening 14*c* may have any shape such as a rectangle as long as the opening is large enough to enable the laser light 3*a* to be irradiated in the printable region of the photosensitive drum 1.

In addition, as shown in FIGS. 1 and 7, by providing the cleaning unit 13 with the opening 14*c* and arranging the first guided portion 14*d* on the side of the developing unit 4 across the laser light 3*a*, the developing unit 4 is exposed to an exterior near center in the longitudinal direction. Accordingly, only the developing unit 4 exposed to the exterior near center in the longitudinal direction can be made graspable. By making only the developing unit 4 graspable as in the case of the embodiment, rotational movements of the developing unit 4 and the cleaning unit 13 can be prevented during handling by the user. As a result, operability is improved.

As described above, according to the configuration of the present embodiment described above, by providing an opening between a center of a photosensitive drum and a guided portion of a frame body, a wall on a side of a cleaning apparatus with respect to laser light in a cross section viewed from an axial direction of the photosensitive drum is eliminated. Therefore, since a gap L1 between laser light and the wall as well as a thickness L2 of the wall itself which have conventionally been provided no longer exist, the cleaning apparatus or a process cartridge can be downsized. In addition, by arranging a part of a developing unit of an adjacent process cartridge in the region described above, a downsized image forming apparatus can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-037953, filed Feb. 27, 2015, which is hereby incorporated by reference herein in its entirety.

The invention claimed is:

1. A cartridge attachable to and detachable from an apparatus main body of an image forming apparatus that forms an image on a recording material, the cartridge being used with a developing unit that is attachable to the apparatus main body and positioned adjacent to the cartridge, the cartridge comprising:

a photosensitive body; and a frame body that supports the photosensitive body, wherein the frame body includes a first restricted portion that is restricted by a first restricting portion provided in the apparatus main body and a second restricted portion that is restricted by a second restricting portion provided in the apparatus main body, wherein the first restricted portion and second restricted portion are configured such that, when viewed along a longitudinal direction of the photosensitive body, a straight line connecting the first restricted portion and the second restricted portion crosses a path of light for exposing the photosensitive body, wherein the frame body is provided with an opening portion for allowing the light to pass through, and wherein, when viewed along the longitudinal direction of the photosensitive body, with respect to the path of light, the first restricted portion is positioned on a same side as the developing unit and the second restricted portion is positioned on a side opposite to the developing unit.

2. The cartridge according to claim 1, wherein the opening portion is configured such that a width of the opening portion in a scanning direction in an irradiation range of the light for exposing the photosensitive body becomes greater toward a side of the photosensitive body from a side of a light source of the light for exposing the photosensitive body.

3. The cartridge according to claim 1, wherein the first restricted portion is provided at a position more separated from the photosensitive body than the second restricted portion.

4. The cartridge according to claim 1, wherein, when viewed along the longitudinal direction of the photosensitive body, another developing unit is attachable to the apparatus main body on a side opposite to the developing unit in the apparatus main body with respect to the cartridge, and wherein the first restricted portion is positioned on an opposite side so as to sandwich the path of light with the other developing cartridge.

5. The cartridge according to claim 1, wherein the frame body includes a connecting portion that connects the first restricted portion and the second restricted portion with each other.

6. The cartridge according to claim 1, wherein the light for exposing the photosensitive body is laser light.

7. The cartridge according to claim 1, further comprising:

a charging member that charges the photosensitive body;

a cleaning member that cleans a surface of the photosensitive body; and a housing portion that houses a removed object having been removed by the cleaning member from the surface of the photosensitive body.

8. The cartridge according to claim 7, wherein the housing portion includes a discharge port for discharging the removed object to outside of the cartridge, and a conveying member that conveys the removed object toward the discharge port.

9. A process cartridge that is attachable to and detachable from an apparatus main body of an image forming apparatus, the process cartridge comprising:

the cartridge according to claim 1; and a developing cartridge provided with a developer bearing member that bears developer for developing an electrostatic image formed on the photosensitive body.

10. The process cartridge according to claim 9, wherein the developing cartridge further includes a developer housing portion having a housing chamber that houses developer and a plurality of vent holes for ventilation between the inside and the outside of the housing chamber, and wherein a hole size of a vent hole at a position opposing the frame body, from among the plurality of vent holes, is larger than a hole size of a vent hole at a position exposed via the opening.

11. An image forming apparatus forming an image on a recording material, wherein the cartridge according to claim 1 is configured in plurality to be attachable to and detachable from an apparatus main body of the image forming apparatus.

12. The cartridge according to claim 1, wherein the cartridge is attached to or detached from the apparatus main body along an axial direction of the photosensitive body.

13. The cartridge according to claim 1, wherein, when viewed along the longitudinal direction of the photosensitive body, a shortest distance from the first restricted portion to another straight line in which the path of light exists, is shorter than a shortest distance from the second restricted portion to the another straight line.

14. The cartridge according to claim 1, wherein the light for exposing the photosensitive body emits from a side of the first restricted portion to a side of the second restricted portion along the path of the light.

* * * * *